US005576596A

United States Patent [19]

Curtin et al.

[11] Patent Number: 5,576,596

[45] Date of Patent: Nov. 19, 1996

[54] OPTICAL DEVICES SUCH AS FLAT-PANEL CATHODE RAY TUBE, HAVING RAISED BLACK MATRIX

[75] Inventors: Christopher J. Curtin, Cupertino; Ronald S. Nowicki, Sunnyvale; Theodore S. Fahlen, San Jose; Robert M. Duboc, Jr., Menlo Park; Paul A. Lovoi, Saratoga, all of Calif.

[73] Assignee: Silicon Video Corporation, San Jose, Calif.

[21] Appl. No.: 450,458

[22] Filed: May 25, 1995

Related U.S. Application Data

[60] Division of Ser. No. 188,856, Jan. 31, 1994, Pat. No. 5,477,105, which is a continuation-in-part of Ser. No. 12,542, Feb. 1, 1993, which is a continuation-in-part of Ser. No. 867,044, Apr. 10, 1992, Pat. No. 5,424,605.

[51] Int. Cl.[6] ..... H01J 29/18

[52] U.S. Cl. ..... 313/422; 313/496; 313/268; 313/292; 313/463; 313/466

[58] Field of Search ..... 313/422, 496, 313/292, 268, 463, 466, 169.4, 495, 577; 345/41, 37, 50

[56] References Cited

U.S. PATENT DOCUMENTS

| | | | |
|---|---|---|---|
| 3,755,704 | 8/1973 | Spindt et al. | 313/309 |
| 3,935,499 | 1/1976 | Oess | 313/413 |
| 4,088,920 | 5/1978 | Siekanowicz et al. | 313/422 |
| 4,174,523 | 11/1979 | Marlowe et al. | 315/13 R |
| 4,227,117 | 10/1980 | Watanabe et al. | 315/13 R |
| 4,677,259 | 6/1987 | Abe | 178/18 |
| 4,857,799 | 8/1989 | Spindt et al. | 313/495 |
| 4,884,010 | 11/1989 | Biberian | 315/366 |
| 4,887,000 | 12/1989 | Yamazaki et al. | 313/422 |
| 4,900,981 | 2/1990 | Yamazaki et al. | 313/422 |
| 4,908,539 | 3/1990 | Meyer | 315/169.3 |

(List continued on next page.)

FOREIGN PATENT DOCUMENTS

| | | |
|---|---|---|
| 0436997A1 | 7/1991 | European Pat. Off. . |
| 0464938A1 | 1/1992 | European Pat. Off. . |
| 0496450A1 | 7/1992 | European Pat. Off. . |
| 0580244A1 | 1/1994 | European Pat. Off. . |
| 54-138367 | 10/1979 | Japan . |

OTHER PUBLICATIONS

Andreadakis et al., "Influence of Barrier Ribs on the Memory Margin of ac Plasma Display Panels", *Proceedings of the SID*, vol. 31/4, 1990, pp. 355–360.

Brodie et al., "Vacuum Microelectronics", *Advances in Electronics and Electron Physics*, vol. 83, 1992, pp. 1–106.

Fujii et al., "37.5: A Sandblasting Process for Fabrication of Color PDP Phosphor Screens", *SID 92 Digest*, 1992, pp. 728–731.

Goede, "Digital Address Thin Display Tube", Northrop Corp./NTIS, Nov. 1974, pp. 1–134.

Goede, "A Digitally Addressed Flat–Panel CRT", *IEEE Transactions on Electron Devices*, vol. ED–20, No. 11, Nov. 1973, pp. 1052–1061.

(List continued on next page.)

*Primary Examiner*—Sandra L. O'Shea
*Assistant Examiner*—Ashok Patel
*Attorney, Agent, or Firm*—Skjerven, Morrill, MacPherson, Franklin & Friel; Alan H. MacPherson; Ronald J. Meetin

[57] ABSTRACT

An optical device contains first and second plates (302 and 303), a pattern of ridges (314) situated over the first plate, light-emissive regions (313) situated in spaces between the ridges, electron-emissive elements (309) situated over the second plate, and supporting structure (308) that maintains a desired spacing between the plates. The electron-emissive elements emit electrons that strike the light-emissive regions, causing them to produce light of various colors. The ridges, which extend further away from the first plate than the light-emissive regions, are substantially non-emissive of light when hit by electrons. Each ridge includes a dark region formed with metal, ceramic, semiconductor, or/and carbide. The ridges thereby form a raised black matrix that improves contrast and color purity.

10 Claims, 9 Drawing Sheets

U.S. PATENT DOCUMENTS

| | | | |
|---|---|---|---|
| 4,928,035 | 5/1990 | Schlipf | 313/466 |
| 4,940,916 | 7/1990 | Borel et al. | 313/306 |
| 4,956,574 | 9/1990 | Kane | 313/306 |
| 4,975,619 | 12/1990 | Datta et al. | 313/466 |
| 5,003,219 | 3/1991 | Muragishi et al. | 313/456 |
| 5,012,155 | 4/1991 | Datta et al. | 313/466 X |
| 5,053,673 | 10/1991 | Tomii et al. | 313/308 |
| 5,063,327 | 11/1991 | Brodie et al. | 313/495 X |
| 5,083,058 | 1/1992 | Nonomura et al. | 313/422 X |
| 5,116,704 | 5/1992 | Kwon | 313/495 X |
| 5,160,871 | 11/1992 | Tomii et al. | 313/422 X |
| 5,229,691 | 7/1993 | Shichao et al. | 313/422 X |
| 5,313,136 | 5/1994 | Van Gorkom et al. | 313/422 |

OTHER PUBLICATIONS

Little, "Microminiature Refrigeration", Rev. Sci. Instrum., vol. 55, No. 5, May 1984, pp. 661–680.

Meyer, 6 "Diagonal Microtips Flourescent Display for T.V. Applications", *EuroDisplay Digest*, Sep. 1990, (4 pages).

Mueller et al., "28.2: Tiling thin–Film Electroluminescent Displays", *SID 91 Digest*, 1991, pp. 567–570.

Takahashi et al., "Back Modulation Type Flat CRT", Japan Display '92, 1992, pp. 377–380.

Tannas, Jr., *Flat–Panel Displays and CRTs*, 1985, pp. 218–219, 231–232, 360, 400, 403.

Terao et al., "37.4: Fabrication of Fine Barrier Ribs for Color Plasma Display Panels by Sandblasting", *SID 92 Digest*, 1992, pp. 724–727.

OPTICAL DEVICES SUCH AS FLAT-PANEL CATHODE RAY TUBE, HAVING RAISED BLACK MATRIX

CROSS-REFERENCE TO RELATED APPLICATIONS

This is a division of U.S. patent application Ser. No. 08/118,856, filed 31 Jan. 1994, now U.S. Pat. No. 5,477,105, which is a continuation-in-part of U.S. patent application Ser. No. 08/012,542, filed 1 Feb. 1993, now allowed, which is a continuation-in-part of U.S. patent application Ser. No. 07/867,044, filed 10 Apr. 1992, now U.S. Pat. No. 5,424,605.

BACKGROUND OF THE INVENTION

1. Field of the Invention

This invention relates to light-emitting structures for optical devices such as cathode-ray tube ("CRT") displays of the flat-panel type. More particularly, this invention relates to light-emitting structures in which certain portions produce light when struck by electrons and in which other portions, conventionally referred to as "black matrices", are substantially non-emissive of light when struck by electrons. This invention also relates to the manufacture of light-emitting structures containing black matrices.

2. Description of Related Art

A flat-panel CRT display contains a transparent faceplate, a backplate (sometimes referred to as a baseplate), and connecting walls situated outside the active picture area to form a sealed enclosure. The CRT display is typically maintain at a very low internal pressure. An array of laterally separated sets of cathodic electron-emissive elements are situated along the interior surface of the backplate. A phosphor coating, typically divided into an array of separate phosphor regions, is situated along the interior surface of the faceplate.

During display operation, the electron-emissive elements are selectively excited to cause certain of the elements to emit electrons that move towards phosphors on the faceplate. These phosphors, upon being struck by the impinging electrons, emit light that is visible at the exterior surface of the faceplate.

The electrons emitted from each of the sets of electron-emissive elements are intended to strike only certain target phosphors. However, some of the emitted electrons invariably strike portions of the faceplate outside the target phosphors. To improve contrast at the faceplate, a matrix of dark non-reflective regions that emit substantially no light when struck by electrons from the electron-emissive elements are suitably dispersed among the phosphor regions. In a color display, this black matrix also improves color purity. The phosphor regions extend further away from the faceplate than the black matrix.

In a flat-panel plasma display formed with a pair of glass plates, barrier ribs consisting of metal or dielectric material are typically inserted between the plates to maintain a desired inter-plate spacing. Andreadakis et al, "Influence of Barrier Ribs on the Memory Margin of ac Plasma Display Panels," *Procs. SID,* Vol. 31/4, 1990, presents a study on various configurations for barrier ribs in plasma display panels. Techniques for manufacturing barrier ribs for plasma display panels are described in (a) Fujii et al, "A Sandblasting Process for Fabrication of Color PDP Phosphor Screens," *SID* 92 *Digest,* 1992, pp. 728–731, (b) Terso et al, "Fabrication of Fine Barrier Ribs for Color Plasma Display Panels by Sandblasting," *SID* 92 *Digest,* 1992, pp. 724–727, and (c) Kwon, U.S. Pat. No. 5,116,704. Both Fujii et al and Terso et al use sandblasting techniques in forming barrier ribs. Fujii et al also employs sandblasting in fabricating light-emitting phosphor structures for plasma display panels.

SUMMARY OF THE INVENTION

The present invention furnishes a light-emitting structure suitable for use in optical devices such as flat-panel CRT displays. The light-emitting structure of the invention contains a main section, a pattern of ridges situated along the main section, and a plurality of light-emissive regions situated along the main section in spaces between the ridges. The light-emissive regions produce light upon being struck by electrons. The ridges, in contrast, are substantially non-emissive of light when hit by electrons. The ridges extend further away from the main section than the light-emissive regions.

Each ridge includes a dark region that encompasses substantially the entire width of that ridge and at least part of its height. The pattern of ridges thereby forms a raised black matrix that improves the contrast of the light-emitting structure. The raised black matrix also enhances the color purity when the light-emissive regions selectively produce light of two or more colors.

In a typical optical device that utilizes the present light-emitting structure, the main section constitutes the first of a pair of plates having internal surfaces that face, and are spaced apart, from each other. The light-emissive regions and the raised ridges are situated along the internal surface of the first plate. The first plate is transparent at least in portions extending along the light-emissive regions. An array of laterally separated sets of electron-emissive elements are situated along the internal surface of the second plate. The electron-emissive elements emit electrons that cause the light-emissive regions to emit light. The optical device contains supporting structure that supports the two plates and keeps them spaced apart from each other.

The support structure preferably includes a group of laterally separated internal supports situated between the ridges and the second plate so as to cross the ridges. The internal supports extend towards areas between the electron-emissive elements. As a result, the internal supports are largely not visible at the exterior surface of the faceplate—i.e., the viewing surface.

The light-emissive regions are typically quite fragile. Because the ridges extend further away from the first plate than the light-emissive regions, the ridges prevent the internal supports from directly exerting force on the light-emissive regions. The combination of internal supports and raised ridges thereby provides a mechanism for maintaining a desired spacing between the two plates along the full active area of the optical device without subjecting the fragile light-emissive regions to potentially damaging mechanical forces produced by the internal supports. This increases device reliability.

The light-emitting structure of the invention can be fabricated according to various techniques. In one group of techniques according to the invention, the pattern of ridges is formed along the main section by a process that involves selectively removing portions of a layer of ridge material provided along the main section. In another group of techniques according to the invention, portions of a body of largely uniform composition are selectively removed to a specified depth such that the remainder of the body comprises the main section and the pattern of ridges.

BRIEF DESCRIPTION OF THE DRAWINGS

Like reference symbols are employed in the drawings and in the description of the preferred embodiments to represent the same or very similar item or items.

DESCRIPTION OF THE PREFERRED EMBODIMENTS

Herein, a flat panel CRT display is an optical device which contains a faceplate and a backplate that are substantially parallel and in which the thickness of the display is small compared to the thickness of a conventional deflected-beam CRT display. The thickness of a flat panel CRT display according to the invention is typically less than 5 cm.

Figure 1B:
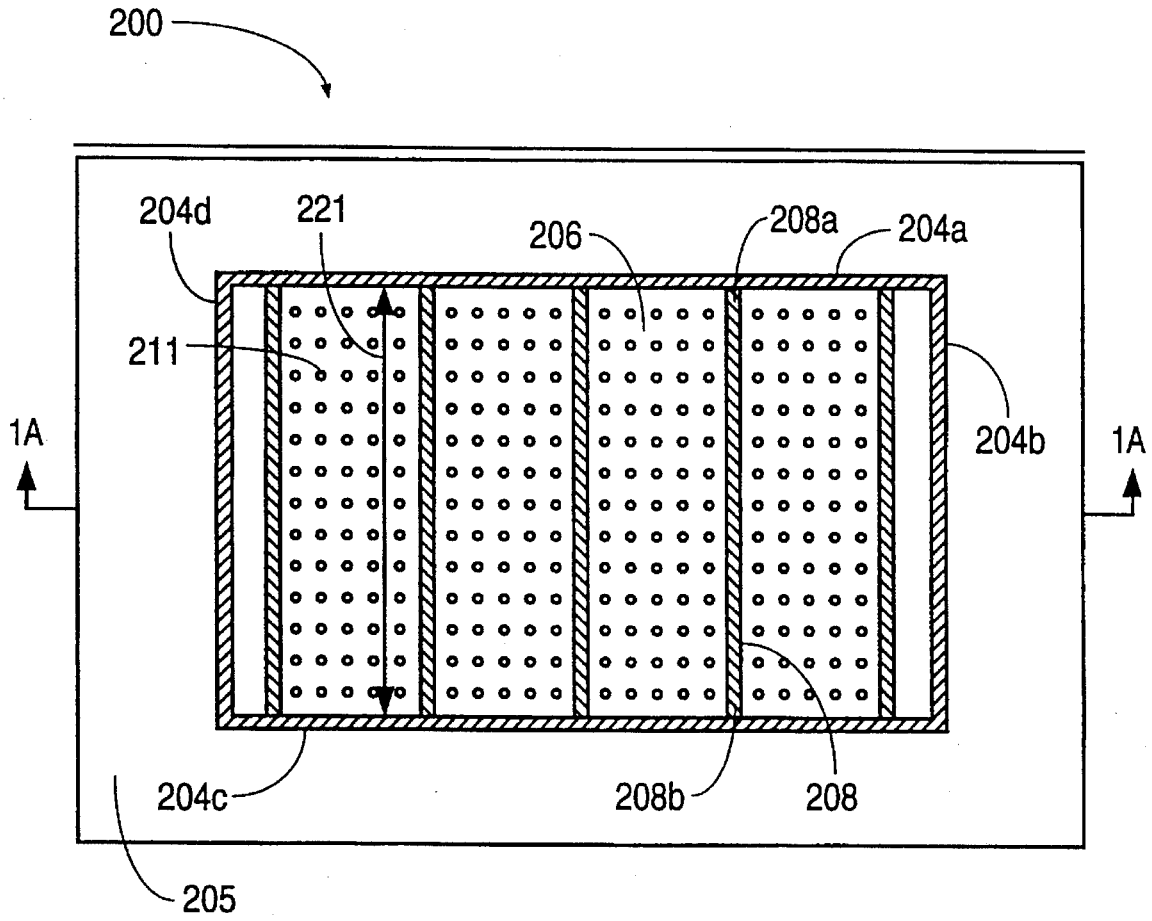
FIGS. 1A and 1B are simplified cross-sectional views of a flat-panel CRT display in accordance with the invention. The cross section of FIG. 1A is taken along plane 1A—1A in FIG. 1B. The cross section of FIG. 1B is taken along plane 1B—1B in FIG. 1A.
Figure 1A:
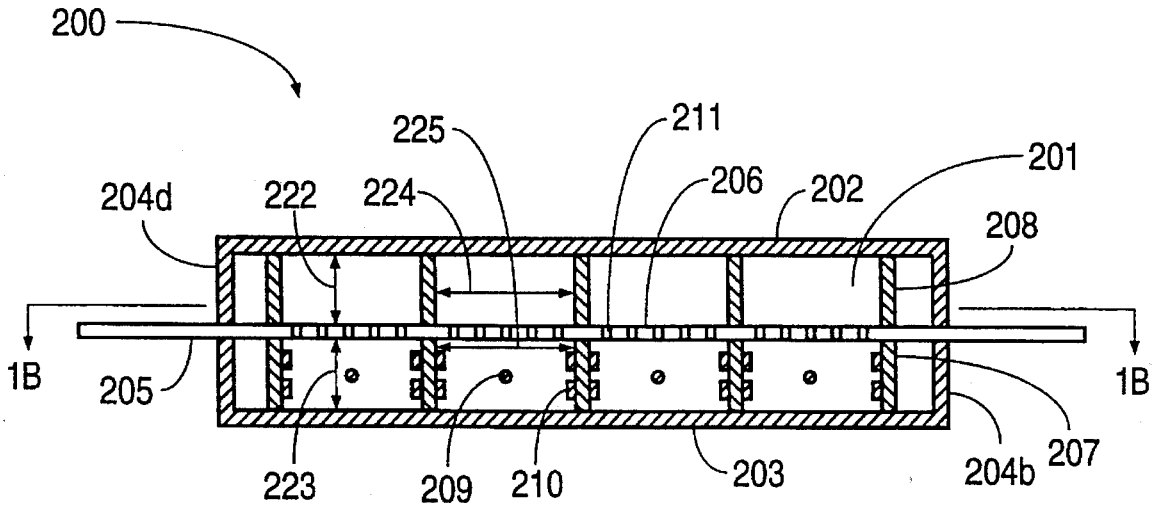

Referring to FIGS. 1A and 1B, they illustrate a flat panel CRT display 200 configured according to the teachings of the invention. Flat panel display 200 contains a transparent faceplate 202, a backplate 203, a top wall 204*a*, a bottom wall 204*c*, and side walls 204*b* and 204*d* which together from an enclosure 201 set at a pressure in the vicinity of $10^{-7}$ torr. The interior surface of faceplate 202 is coated with phosphors or phosphor patterns. A layer 205 is disposed between faceplate 202 and backplate 203. An addressing grid 206 is formed on the portion of layer 205 situated opposite the active faceplate region—i.e., the phosphor coated portion of faceplate 202. Cathode spacer walls 207 are disposed between backplate 203 and addressing grid 206. Anode spacer walls are disposed between faceplate 202 and addressing grid 206.

A thermionic cathode is located between addressing grid 206 and backplate 203. The thermionic cathode includes cathode wires 209 and directional electrodes 210 formed on cathode spacer walls 207. Although not shown, electrodes could also be formed on backplate 203.

Cathode wires 209 are heated to release electrons. A voltage may be applied to directional electrodes 210 to help shape the electron distribution and electron paths as the electrons move toward addressing grid 206. Voltages applied to electrodes (not shown) on the surfaces of holes 211 in addressing grid 206 determine whether the electrons pass through addressing grid 206 to strike the phosphor coating on faceplate 202. Addressing grid 206 may contain electrodes that direct the electrons to strike a particular phosphor region or regions, and electrodes that focus the electron distribution.

Distance 222 between the phosphor coated interior surface of faceplate 202 and the facing surface of addressing grid 206 depends upon voltage breakdown requirements. Distance 223 between the interior surface of backplate 203 and the facing surface of addressing grid 206 depends upon the uniformity of the electron flow from the cathode. Spacing 224 of anode spacer walls 208 is determined according to mechanical and electrical constraints. The same applies to spacing 225 of cathode spacer walls 207.

The entire active region of faceplate 202 may not be covered by phosphor. The phosphor can be segmented into regions. Phosphor regions can be defined by surrounding them with a black border or matrix to improve contrast. In order to avoid a "prison cell effect" on the external viewing surface of faceplate 202, anode spacer walls 208 must be located over the black matrix of the active region of faceplate 202 so that anode spacer walls 208 are not seen at the external viewing surface.

In one embodiment of the invention, the black matrix is raised above the phosphor coating on the interior surface of faceplate 202 by photolithographic patterning and etching away of the black matrix material in the areas to be coated with phosphor. Anode spacer walls 208 contact a part of the black matrix. Since the black matrix is raised above the remainder of faceplate 202, even if anode spacer walls 208 slide from their original position on the black matrix, anode spacer walls 208 are held above the phosphor coating by another part of the black matrix so that the phosphor coating is not damaged by anode spacer walls 208.

Figure 2:
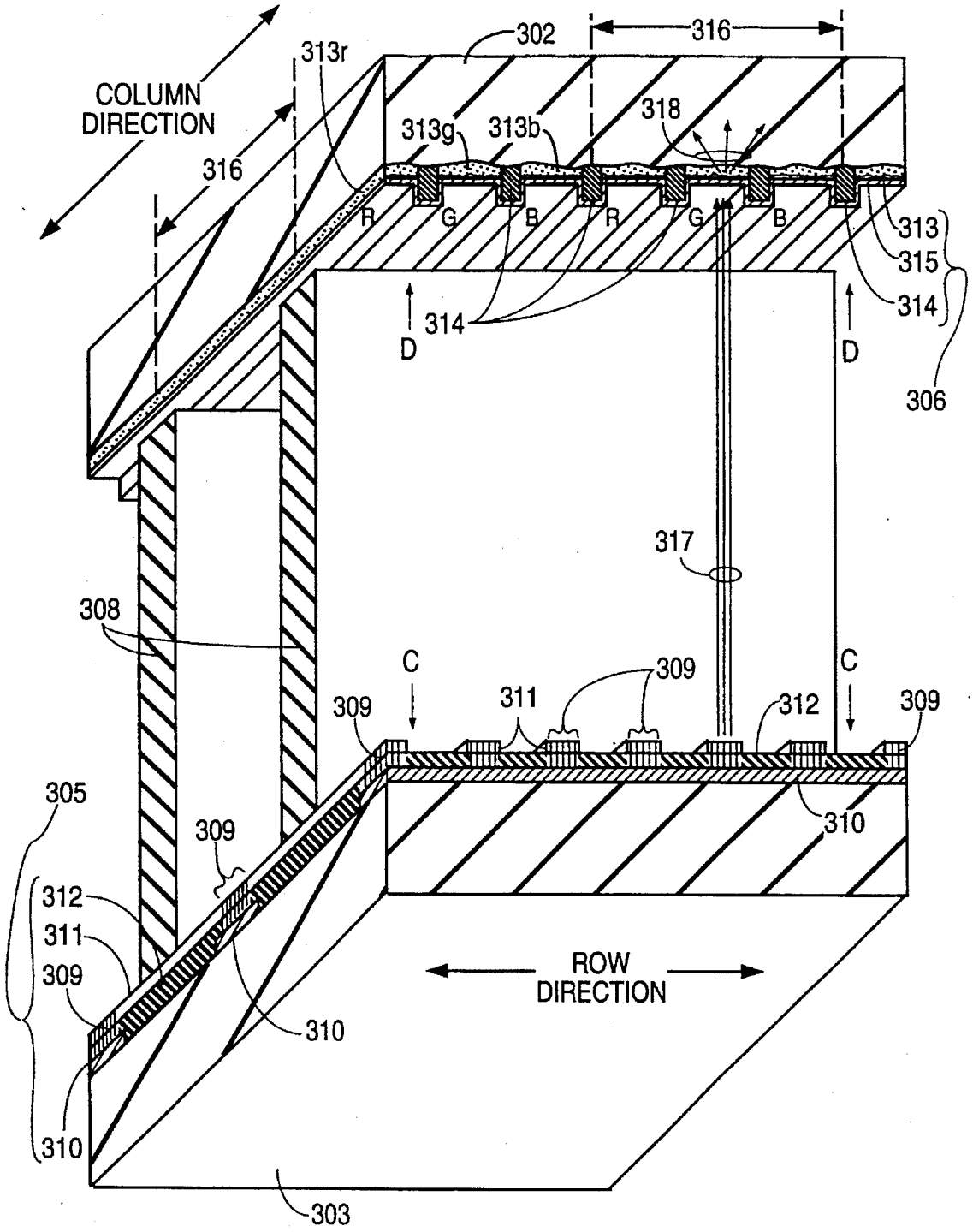
FIG. 2 is a cross-sectional perspective view of part of a flat-panel CRT display that utilizes a raised black matrix in accordance with the invention.

FIG. 2 illustrates part of a flat-panel color CRT display that employs an area field-emission cathode in combination with a raised black matrix. The CRT display in FIG. 2 contains a transparent electrically insulating flat faceplate 302 and an electrically insulating flat backplate 303. The internal surfaces of plates 302 and 303 face each other and are typically 0.01–2.5 mm apart. Faceplate 302 consists of glass typically having a thickness of 1 mm. Backplate 303 consists of glass, ceramic, or silicon typically having a thickness of 1 mm.

A group of laterally separated electrically insulating spacer walls 308 are situated between plates 302 and 303. Spacer walls 308 extend parallel to one another at a uniform spacing. Walls 308 extend perpendicular to plates 302 and 303. Each wall 308 consists of ceramic typically having a thickness of 80–90 μm. The center-to-center spacing of walls 308 is typically 8–25 mm. As discussed further below, walls 308 constitute internal supports for maintaining the spacing between plates 302 and 303 at a substantially uniform value across the entire active area of the display.

Figure 3B:
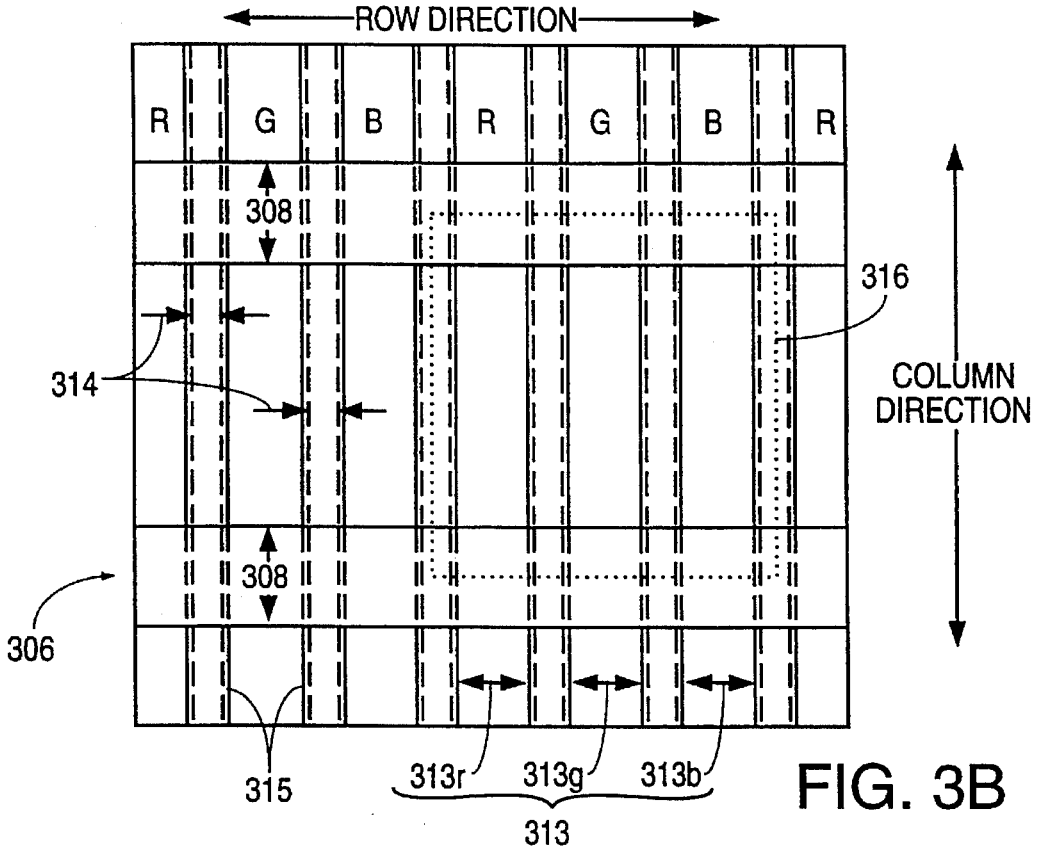
FIGS. 3A and 3B are plan views of internal parts of the display of FIG. 2 as seen respectively from the positions of, and in the directions of, arrows C and D.
Figure 3A:
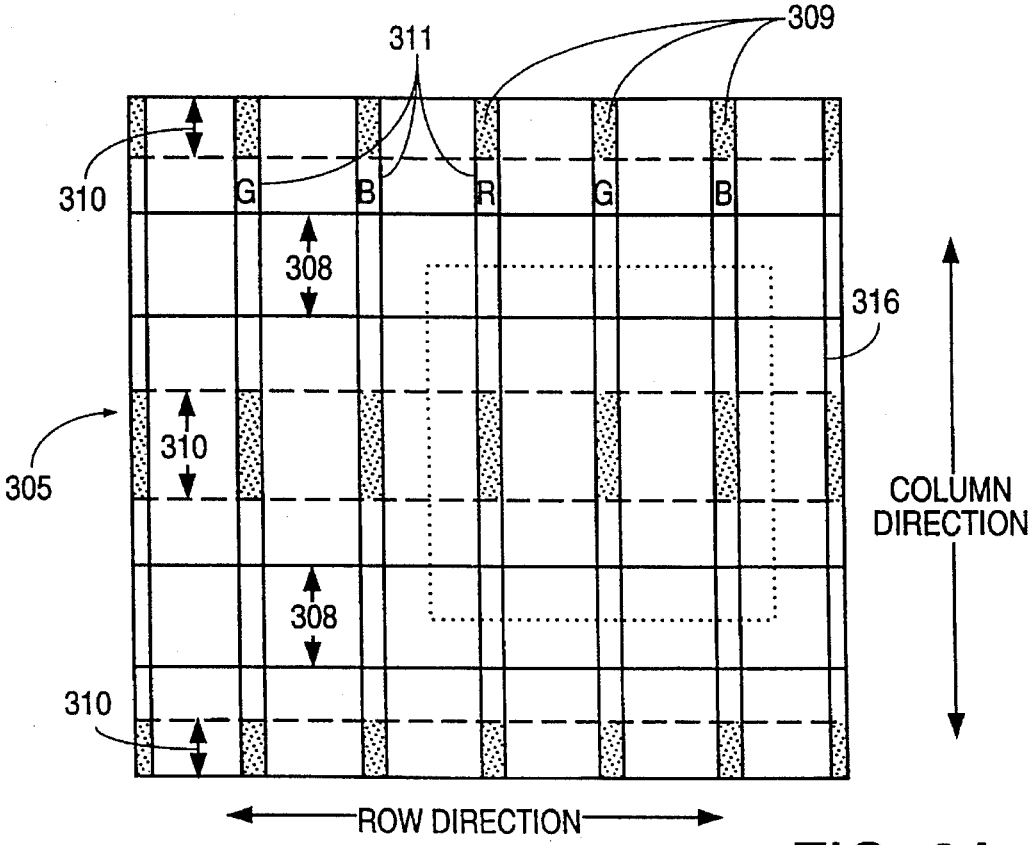

A patterned area field-emission cathode structure 305 is situated between backplate 303 and spacer walls 308. FIG. 3A depicts the layout of the field-emission cathode structure 305 as viewed in the direction, and from the positions, represented by arrows C in FIG. 2. Cathode structure 305 consists of a large group of electron-emissive elements 309, a patterned metallic emitter electrode (sometimes referred to as base electrode) divided into a group of substantially identical straight lines 310, a metallic gate electrode divided into a group of substantially identical straight lines 311, and an electrically insulating layer 312.

Emitter-electrode lines 310 are situated on the interior surface of backplate 303 and extend parallel to one another at a uniform spacing. The center-to-center spacing of emitter lines 310 is typically 315–320 μm. Lines 310 are typically formed of molybdenum or chromium having a thickness of 0.5 μm. Each line 310 typically has a width of 100 μm. Insulating layer 312 lies on lines 310 and on laterally adjoining portions of backplate 303. Insulating layer 312 typically consists of silicon dioxide having a thickness of 1 μm.

Gate-electrode lines 311 are situated on insulating layer 312 and extend parallel to one another at a uniform spacing. The center-to-center spacing of gate lines 311 is typically 105–110 μm. Gate lines 311 also extend perpendicular to emitter lines 310. Gate lines 311 are typically formed with a titanium-molybdenum composite having a thickness of 0.02–0.5 μm. Each line 311 typically has a width of 30 μm.

Electron-emissive elements 309 are distributed above the interior surface of backplate 303 in an array of laterally separated multi-element sets. In particular, each set of electron-emissive elements 309 is located above the interior surface of backplate 303 in part or all of the projected area where one of gate lines 311 crosses one of emitter lines 310. Spacer walls 308 extend towards areas between the sets of electron-emissive elements 309 and also between emitter lines 310.

Each electron-emissive element 309 is a field emitter that extends through an aperture (not shown) in insulating layer 310 to contact an underlying one of emitter lines 310. The top (or upper end) of each field emitter 309 is exposed through a corresponding opening (not shown) in an overlying one of gate lines 311.

Field emitters 309 can have various shapes such as needle-like filaments or cones. The shapes of field emitters 309 is not particularly material here as long as they have good electron-emission characteristics. Emitters 309 can be manufactured according to various processes, including those described in Macaulay et al, U.S. patent application Ser. No. 08/118,490, filed 8 Sep. 1993, now U.S. Pat. No. 5,462,467 and Spindt et al, U.S. patent application Ser. No. 08/158,102, filed 24 Nov. 1993 now allowed. The contents of Ser. Nos. 08/118,490 and 08/158,102 are incorporated by reference herein.

A light-emitting structure 306 which contains a black matrix is situated between faceplate 302 and spacer walls 308. Light-emitting structure 306 consists of a group of light-emissive regions 313, a pattern of substantially identical dark ridges 314 that reflect substantially no light, and a light-reflective layer 315. FIG. 3B depicts the layout of light-emitting structure 306 as viewed in the direction, and from the positions, represented by arrows D in FIG. 2.

Light-emissive regions 313 and dark ridges 314 are both situated on the interior surface of faceplate 302. Light-emissive regions 313 are located in spaces between dark ridges 314 (or vice versa). When regions 313 and ridges 314 are struck by electrons emitted from electron-emissive elements 309, light-emissive regions 313 produce light of various colors. Dark ridges 314 are substantially non-emissive of light relative to light-emissive regions 313 and thereby form a black matrix for regions 313.

More specifically, light-emissive regions 313 consist of phosphors configured in straight equal-width stripes extending parallel to one another at a uniform spacing in the same direction as gate lines 311. Each phosphor stripe 313 typically has a width of 80 μm. The thickness (or height) of phosphor stripes 313 is 1–30 μm, typically 25 μm.

Phosphor stripes 313 are divided into a plurality of substantially identical stripes **313*r* that emit red (R) light, a like plurality of substantially identical stripes 313*g* that emit green (G) light, and another like plurality of substantially identical stripes 313*b* (B) that emit blue light. Phosphor stripes 313*r*, 313*g*, and 313*b* are repeated at every third stripe 313 as indicated in FIG. 2. Each phosphor stripe 313 is situated across from a corresponding one of gate lines 311. Consequently, the center-to-center spacing of stripes 313 is the same as that of gate lines 311**.

Dark ridges 314 similarly extend parallel to one another at a uniform spacing in the same direction as gate lines 311. The center-to-center spacing of ridges 314 is likewise the same as that of lines 311. The ratio of the average height of each dark ridge 314 to its average width is in the range of 0.5–3, typically 2. The average width of ridges 314 is 10–50 μm, typically 25 μm. The average height of ridges 314 is 20–60 μm, typically 50 μm.

The average height of dark ridges 314 exceeds the thickness (or height) of phosphor stripes 313 by at least 2 μm. In the typical case described above, ridges 314 extend 25 μm above stripes 313. Accordingly, ridges 314 extend further away from faceplate 302 than stripes 313.

Each ridge 314 contains a dark (essentially black) non-reflective region that occupies the entire width of that ridge 314 and at least part of its height. FIG. 2 depicts an example in which these dark non-reflective regions encompass the full height of ridges 314. The later drawings illustrate examples in which the dark non-reflective regions occupy only parts of the ridge height.

The choice of materials for dark ridges 314 is wide. Ridges 314 can be formed with metals such as nickel, chromium, niobium, gold, and nickel-iron alloys. Ridges 314 can also be formed with electrical insulators such as glass, solder glass (or frit), ceramic, and glass-ceramic, with semiconductors such as silicon, and with materials such as silicon carbide. Combinations of these materials can also be utilized in ridges 314.

Certain metals become sufficiently soft at a temperature in the range of 300°–600° C. as to allow objects to be pushed slightly into them. When ridges 314 consist of one or more of these metals, spacer walls 308 can be pushed into ridges 314 as discussed further below. When ridges 314 are formed with solder glass, they so soften at a temperature in the range of 300°–500° C. When the ridge material is glass, ridges 314 soften at a temperature in the range of 500°–700° C.

Light-reflective layer 315 is situated on phosphor stripes 313 and dark ridges 314 as shown in FIG. 2. The thickness of layer 315 is sufficiently small, typically 50–100 nm, that nearly all of the impinging electrons from electron-emissive elements 309 pass through layer 315 with little energy loss.

The surface portions of light-reflective layer 315 adjoining phosphor stripes 313 are quite smooth. Layer 315 consists of a metal, preferably aluminum. Part of the light emitted by stripes 313 is thus reflected by layer 315 through faceplate 302. That is, layer 315 is basically a mirror. Layer 315 also acts as the final anode for the display. Because stripes 313 contact layer 315, the anode voltage is impressed on stripes 313.

Spacer walls 308 contact light-reflective layer 315 on the anode side of the display. Because dark ridges 314 extend further toward backplate 303 than phosphor stripes 313, walls 308 specifically contact portions of layer 315 along the tops (or bottoms in the orientation shown in FIG. 2) of ridges 314. The extra height of ridges 314 prevents walls 308 from contacting light-reflective layer 315 along phosphor stripes 313.

On the cathode side of the display, spacer walls 308 are shown as contacting gate lines 311 in FIG. 2. Alternatively, walls 308 may contact focusing ridges that extend above lines 311 as described in Spindt et al, commonly owned co-filed U.S. patent application Ser. No. 08/188,885, "Field Emitter with Focusing Ridges Situated to Sides of Gate" now allowed, the contents of which are incorporated by reference herein. Walls 308 can be manufactured in a conventional manner, in accordance with U.S. patent application Ser. No. 08/012,542 cited above, or in accordance with Spindt et al, commonly owned co-filed U.S. patent application Ser. No. 08/188,857, "Structure and Operation of High Voltage Supports", now allowed the contents of which are also incorporated by reference herein Ser. No. 08/012, 542 is being continued as U.S. patent application Ser. No. 08/505,841, filed 20 Jul. 1995.

The air pressure external to the display is normally atmospheric—i.e., in the vicinity of 760 torr. The internal pressure of the display is normally set at a value below $10^{-7}$ torr. Since this is much less than the normal external pressure, high differential pressure forces are usually exerted on plates 302 and 303. Spacer walls 308 resist these pressure forces.

Phosphor stripes 313 can be damaged easily if mechanically contacted. Because the extra height of dark ridges 314 creates spaces between walls 308 and the portions of light-reflective layer 315 along stripes 313, walls 308 do not exert their resistance forces directly on stripes 313. The amount of damage that stripes 313 could otherwise incur as a result of these resistive forces is greatly reduced.

The display is subdivided into an array of rows and columns of picture elements ("pixels"). The boundaries of a typical pixel 316 are indicated by lines with arrowheads in FIG. 2 and by dotted lines in FIGS. 3A and 3B. Each emitter line 310 is a row electrode for one of the rows of pixels. For ease of illustration, only one pixel row is indicated in FIGS. 2, 3A, and 3B as being situated between a pair of adjacent spacer walls 308 (with a slight, but inconsequential, overlap along the sides of the pixel row). However, two or more pixel rows, typically 24–100 pixel rows, are normally located between each pair of adjacent walls 308.

Each column of pixels has three gate lines 311: (a) one for red, (b) a second for green, and (c) the third for blue. Likewise, each pixel column includes one of each of phosphor stripes 313*r*, 313*g*, and 313*b*. Each pixel column utilizes four of dark ridges 314. Two of ridges 314 are internal to the pixel column. The remaining two are shared with pixel(s) in the adjoining column(s).

Light-reflective layer 315 and, consequently, phosphor stripes 313 are maintained at a positive voltage of 1,500–10, 000 volts relative to the emitter-electrode voltage. When one of the sets of electron-emissive elements 309 is suitably excited by appropriately adjusting the voltages of emitter lines 310 and gate lines 311, elements 309 in that set emit electrons which are accelerated towards a target portion of the phosphors in corresponding stripe 313. FIG. 2 illustrates trajectories 317 followed by one such group of electrons. Upon reaching the target phosphors in corresponding stripe 313, the emitted electrons cause these phosphors to emit light represented by items 318 in FIG. 2.

Some of the electrons invariably strike parts of the light-emitting structure other than the target phosphors. The tolerance in striking off-target points is less in the row direction (i.e., along the rows) than in the column direction (i.e., along the columns) because each pixel includes phosphors from three different stripes 313. The black matrix formed by dark ridges 314 compensates for off-target hits in the row direction to provide sharp contrast as well as high color purity.

Figure 4:
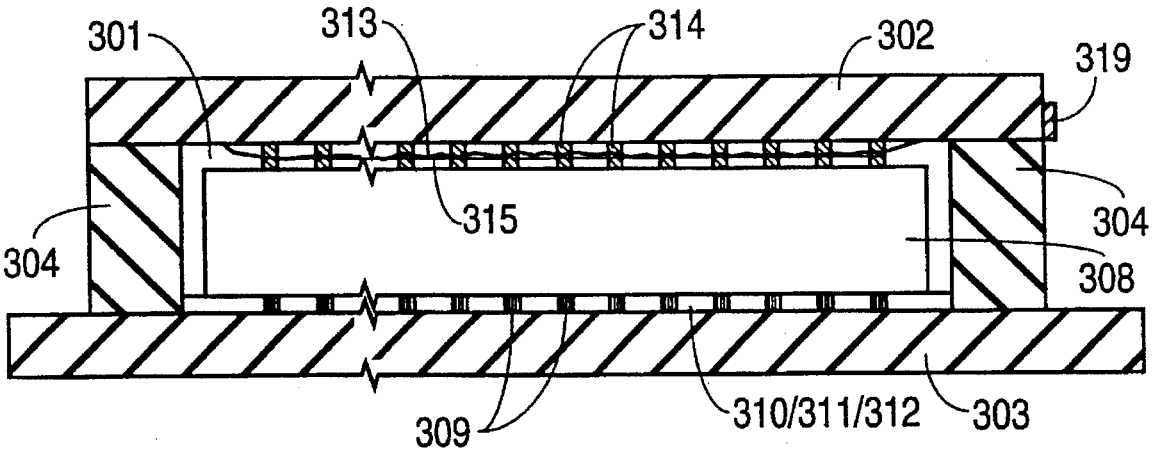
FIG. 4 is a cross-sectional side view of the full flat-panel CRT display of FIG. 2.

FIG. 4 depicts a cross section of the full CRT of FIG. 2. An electrically insulating outer wall 304 extends between plates 302 and 303 outside the active device area to create a sealed enclosure 301. Outer wall 304, which can be formed by four individual walls arranged in a square or rectangle, typically consists of glass or ceramic having a thickness of 2–3 mm. As indicated in FIG. 4, spacer walls 308 typically extend close to outer wall 304. Spacer walls 308 could, however, contact outer wall 304.

Back plate 303 extends laterally beyond faceplate 302. Electronic circuitry (not shown) such as leads for accessing emitter lines 310 and gate lines 311 is mounted on the interior surface of back plate 303 outside outer wall 304. Light-reflective layer 315 extends through the perimeter seal to a contact pad 319 to which the anode/phosphor voltage is applied.

Figure 5:
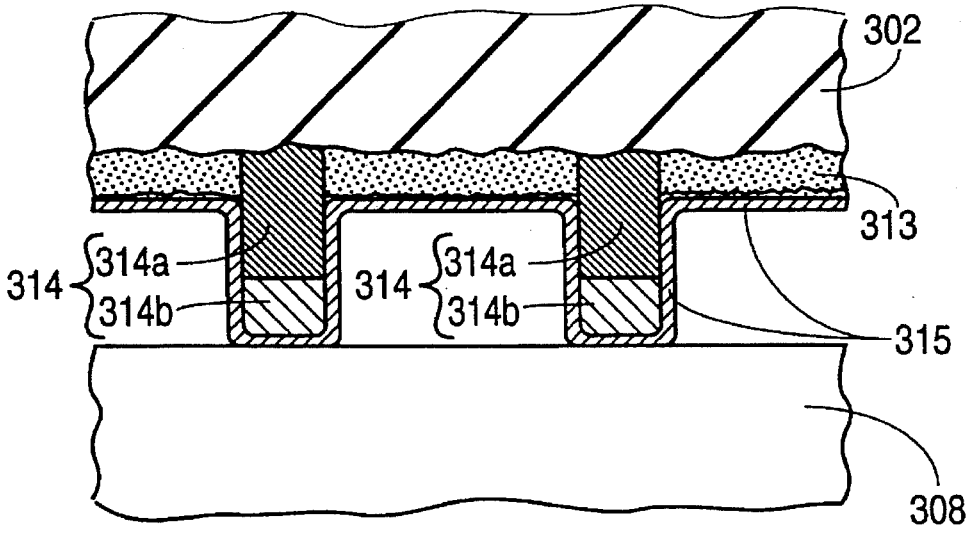
FIG. 5 is a magnified cross-sectional structural view of part of the CRT display of FIG. 2 centering around the black matrix.

FIG. 5 presents an enlarged view of part of the light-emitting black-matrix structure in the CRT display of FIG. 2. For exemplary purposes, each dark ridge 314 in FIG. 5 is illustrated as consisting of a dark main portion 314*a* and a light further portion 314*b*. Dark portion 314*a*, which is situated between faceplate 302 and light portion 314*b*, extends across the entire width of ridge 314 in FIG. 5. Light portion 314*b* is formed with material that can be transparent. FIG. 5 also shows that the surface portions of aluminum light-reflective layer 315 along the interface between phosphors 313 and layer 315 is smooth even though the surface of phosphors 313 along the phosphor/aluminum interface is rough.

FIGS. 6A–6H (collectively "FIG. 6"), FIGS. 7A–7J (collectively "FIG. 7"), FIGS. 8A–8J (collectively "FIG. 8"), and FIGS. 9A–9J (collectively "FIG. 9") illustrate four basic process sequences for manufacturing the light-emitting structure in the CRT display of FIG. 2. To facilitate describing these processes, the orientation of the various regions in FIGS. 6, 7, 8, and 9 is upside down from that in FIG. 2. In the following process description, directional terms such as "upper" and "lower" apply to the directional orientation utilized in FIGS. 6–9.

Beginning with the process sequence shown in FIG. 6, the starting point is faceplate 302. The intended interior surface of faceplate 302—i.e., the upper faceplate surface here—is roughened as indicated in FIG. 6A to reduce the reflectivity of the material used to form the black matrix. The roughening step is typically done with a chemical etchant such as a hydrofluoric acid solution, or with a halogen-based plasma etchant.

Figure 6A:
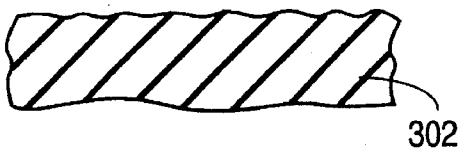
FIGS. 6A, 6B, 6C, 6D, 6E, 6F, 6G, and 6H are cross-sectional views representing steps in manufacturing a light-emitting black-matrix structure for the display of FIG. 2.
Figure 6B:
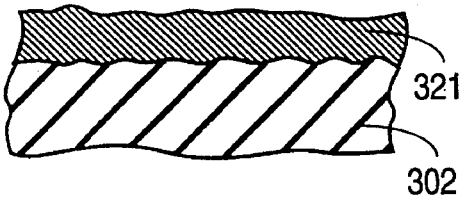
Figure 6C:
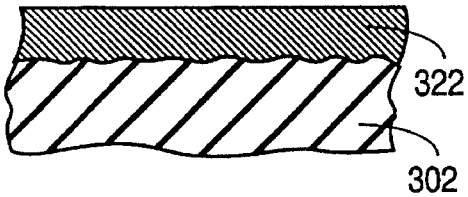
Figure 6D:
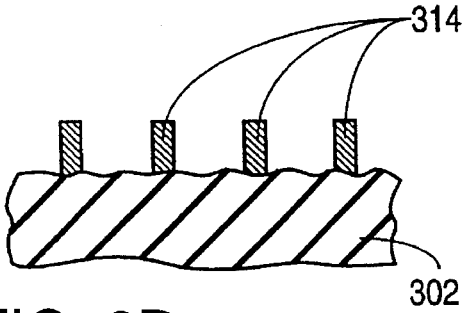

A slurry 321 of solder glass capable of forming dark non-reflective frit is screen deposited on the upper surface of faceplate 302 as shown in FIG. 6B. Slurry 321 is converted to a hardened solder glass layer 322 by firing (i.e., heating)

the structure at 400°–450° C. for 1–120 minutes. See FIG. 6C. Portions of solder glass layer 322 at locations between sites intended for dark ridges 314 are removed by chemical or plasma etching through a suitable photoresist mask (not shown) or by ablation using a suitably programmed laser. FIG. 6D illustrates the resulting structure in which ridges 314 are the remainder of solder glass layer 322.

Figure 6E:
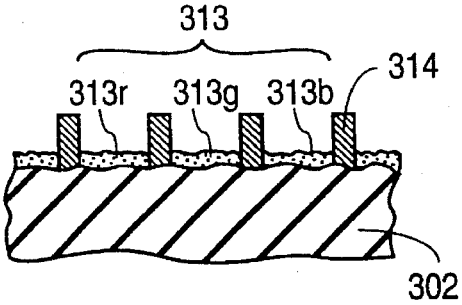

Phosphor stripes 313*r*, 313*g*, and 313*b* are formed on the upper surface of faceplate 302 in the spaces between dark ridges 314 as depicted in FIG. 6E. In particular, a slurry of a polymer, a photosynthesizer, and phosphor particles that emit light of one of the three colors of red, green, and blue is deposited on the upper surface of faceplate 302. The portions of the slurry at the intended sites for the phosphor particles of that color are hardened by exposing those slurry portions to actinic radiation using a suitable photoresist mask (not shown). The remainder of the slurry is poured off, and the structure is rinsed. This procedure is then repeated with phosphor particles that produce light of each of the two remaining colors. The structure is dried to complete the fabrication of phosphor stripes 313.

Figure 6F:
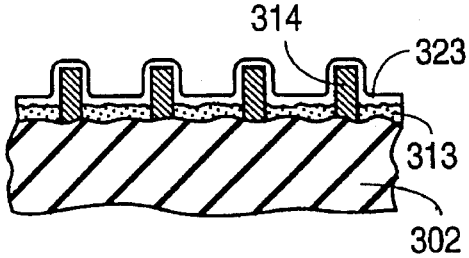
Figure 6G:
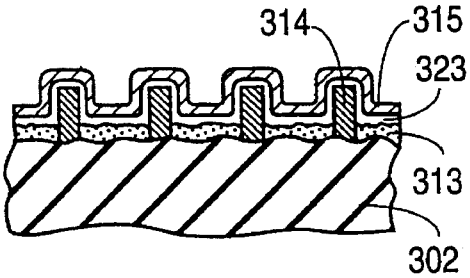
Figure 6H:
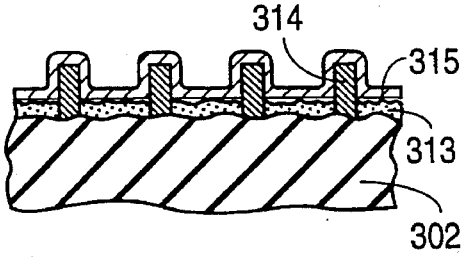
Figure 7A:
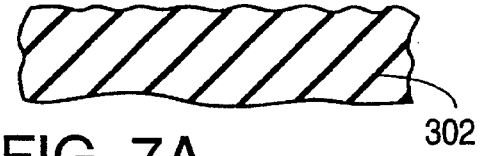
FIGS. 7A, 7B, 7C, 7D, 7E, 7F, 7G, 7H, 7I, and 7J are cross-sectional views representing steps in manufacturing another light-emitting black-matrix structure for the display of FIG. 2.
Figure 7B:
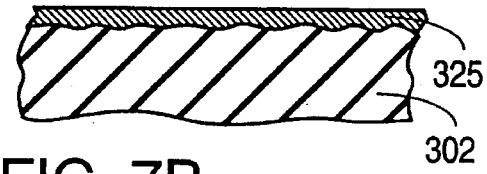

A layer 323 of lacquer is sprayed on phosphors 313 and ridges 314. The upper surface of lacquer layer 323 is smooth as illustrated in FIG. 6F. Aluminum is evaporatively deposited on lacquer layer 323 to form light-reflective layer 315. See FIG. 6G. The structure is then heated at approximately 450° C. for 60 minutes in a partial oxygen atmosphere to burn out lacquer 323. FIG. 7H depicts the final structure while. Because lacquer layer 323 had a smooth upper surface, light-reflective aluminum layer 315 ends up with a smooth lower surface.

Moving to FIG. 7, the starting point again is faceplate 302 whose upper surface is roughened. See FIG. 8A. A layer 325 of a dark non-reflective metal is deposited on the upper surface of faceplate 302 as shown in FIG. 7B. Metal layer 325 typically consists of black chromium or niobium having a thickness of 50–200 nm.

Figure 7C:
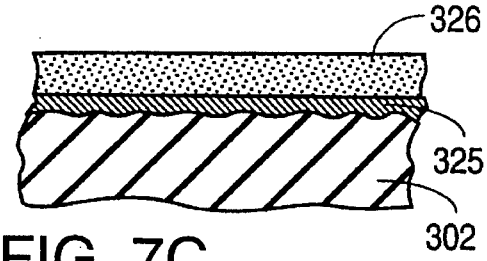
Figure 7D:
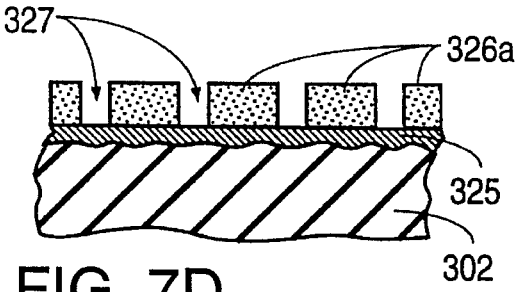

A thick photoresist layer 326 is formed on metal layer 325 as shown in FIG. 7C. Photoresist layer 326 can, for example, consist of a positive photoresist such as Morton EL2026. The photoresist thickness is 25–75 μm, typically 50 μm. Photoresist 326 is selectively exposed to actintic radiation and then developed to form channels 327 of approximately the desired width for ridges 314. That is, the channel width is 10–50 μm, typically 25 μm. See FIG. 7D in which items 326*a* are the remainder of photoresist 326.

Figure 7E:
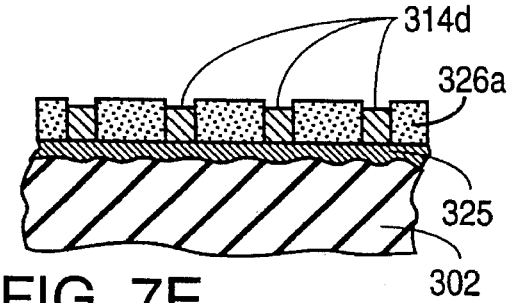
Figure 7F:
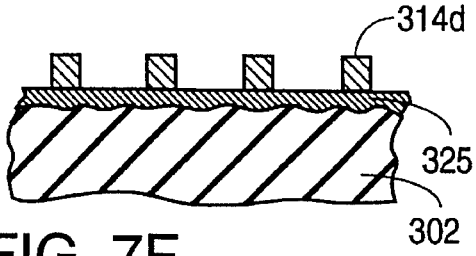

Channels 327 are selectively filled, or nearly filled, with metal to form metal ridges 314*d* as depicted in FIG. 7E. The selective filling is done according to an electrochemical deposition (electroplating) process. Metal ridges 314*d* may consist of dark or opaque metal. Typically, the ridge metal is chrome or a nickel-iron alloy. Photoresist mask 326*a* is subsequently removed to produce the structure shown in FIG. 7F.

Figure 7G:
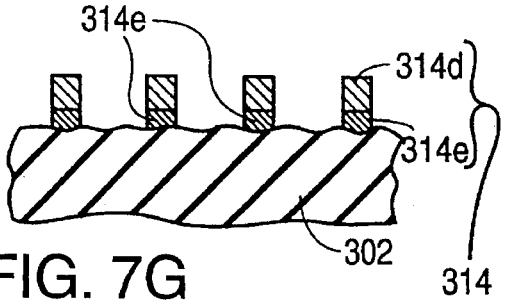
Figure 7H:
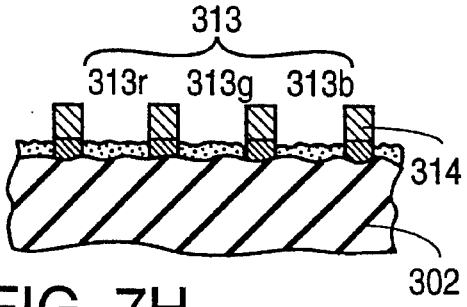

Using metal ridges 314*d* as a mask, the exposed portions of dark metal layer 325 are removed. FIG. 7G illustrates the resulting structure in which dark ridges 314*e* are the remainder of metal layer 325. Each dark ridge 314*e* and overlying ridge portion 314*d* constitute one of dark ridges 314.

Figure 7I:
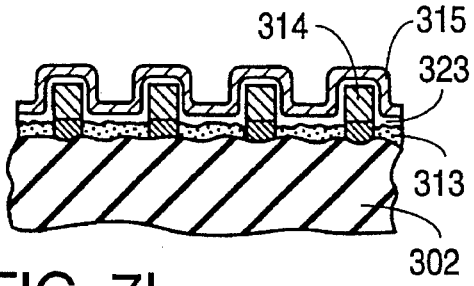
Figure 7J:
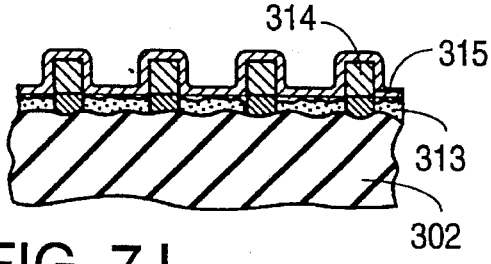

Phosphor stripes 313 and light-reflective layer 315 are now created in the manner discussed above in connection with the process of FIG. 6. FIG. 7H depicts the formation of stripes 313. The deposition of layer 315 over lacquer layer 323 is illustrated in FIG. 7I. FIG. 7J illustrates the final light-emitting structure after lacquer 323 is burned out.

The starting point for the process sequence of FIG. 8 is a transparent electrically insulating flat body (or plate) 329 typically consisting of glass of largely uniform composition. See FIG. 8A. A patterned layer 330 of a material capable of acting as a sandblast mask is formed on the upper surface of transparent body 329 as shown in FIG. 8B. Mask layer 330 can be formed by depositing a blanket layer of the sandblast masking material on body 329 and then removing selected portions of the blanket layer by a masked etch to expose surface portions of body 329.

Figure 8A:
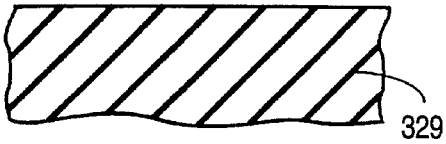
FIGS. 8A, 8B, 8C, 8D, 8E, 8F, 8G, 8H, 8I, and 8J are cross-sectional views representing steps in manufacturing a further light-emitting black-matrix structure for the display of FIG. 2.
Figure 8B:
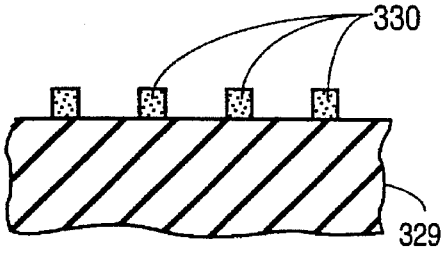
Figure 8C:
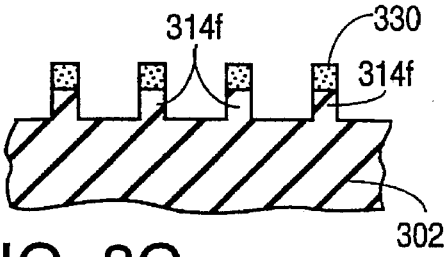
Figure 8D:
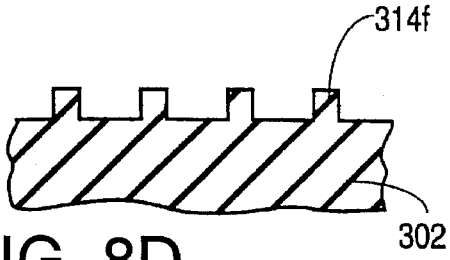
Figure 8E:
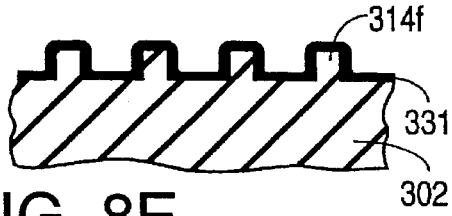

A selective removal operation is performed to remove portions of transparent body 329 to a specified depth at the areas exposed through mask 330. FIG. 8C illustrates the resulting structure in which the remainder of body 329 consists of faceplate 302 and an overlying pattern of ridges 314*f*. The removal operation is done by sandblasting. Mask 330 may be eroded away during the sandblasting. If any of mask 330 is present at the end of the sandblasting, the remainder of mask 330 is removed as indicated in FIG. 8D.

Figure 8F:
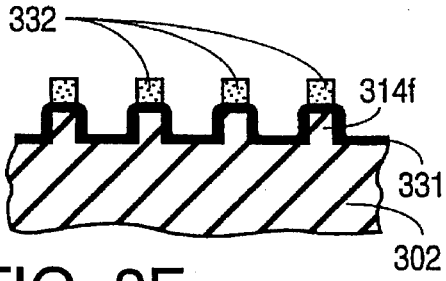

A layer 331 of dark non-reflective material is screen deposited on the upper surface of the structure. See FIG. 8E. The dark material may consist of dark glass or dark metal. A photoresist mask 332 is typically formed on dark layer 331 directly above ridges 314*f* as shown in FIG. 8F. To avoid misalignment, photoresist mask 332 is typically created by using the photomask reticle employed in creating sandblast mask 330 for negative photoresist or a reverse-image mask for positive photoresist.

Figure 8G:
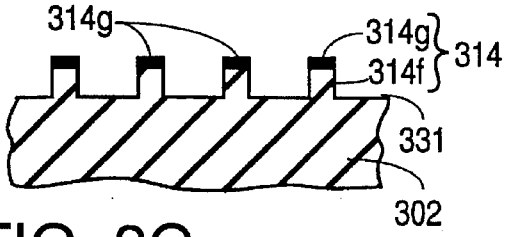

Dark ridge portions 314*g* are respectively created above ridges 314*f* by removing the exposed portions of dark layer 331. FIG. 8G depicts the consequent structure after removal of photoresist 332. Each ridge portion 314*g* and underlying ridge 314*f* constitute one of dark ridges 314.

Figure 8H:
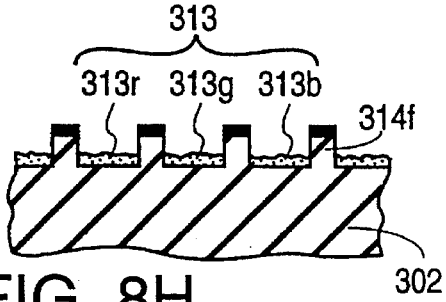
Figure 8I:
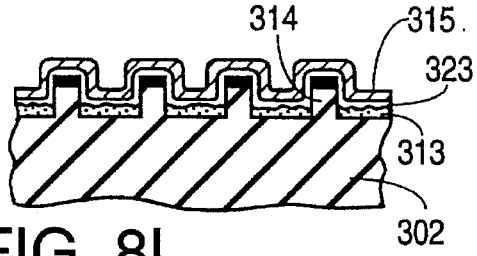
Figure 8J:
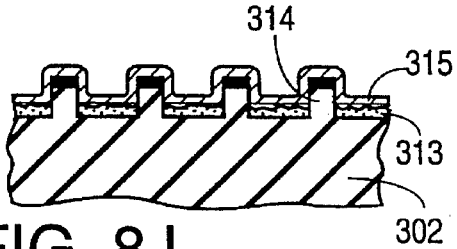

The light-emitting structure is finished in the way described above for the process of FIG. 7. In particular, phosphor stripes 313 are formed in the spaces between ridges 314 as shown in FIG. 8H. FIG. 8I shows the deposition of light-reflective layer 315 over lacquer 323. The final structure is shown in FIG. 8J after burning out lacquer 323.

In FIG. 9, the starting point is again transparent body 329. See FIG. 9A. A layer 325 of metal such as chrome is formed along the upper surface of body 329 as shown in FIG. 9B. Portions of metal layer 335 are selectively removed using a masked etch. See FIG. 9C in which items 335*a* are the remainder of metal layer 335.

Figure 9A:
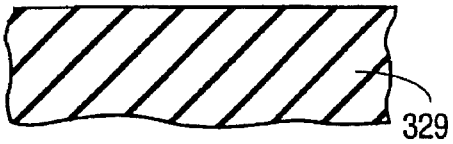
FIGS. 9A, 9B, 9C, 9D, 9E, 9F, 9G, 9H, 9I, and 9J are cross-sectional views representing steps in manufacturing yet another light-emitting black-matrix structure for the display of FIG. 2.
Figure 9B:
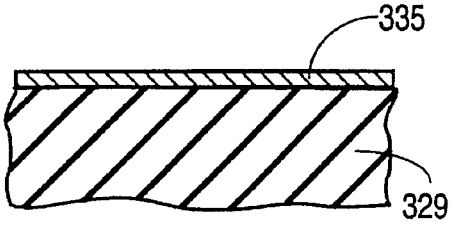
Figure 9C:
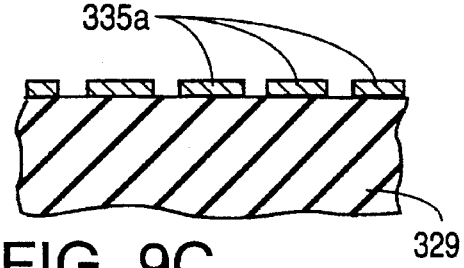
Figure 9D:
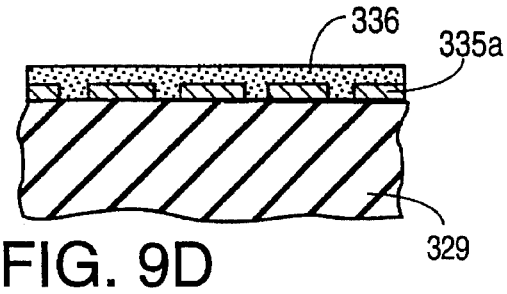
Figure 9E:
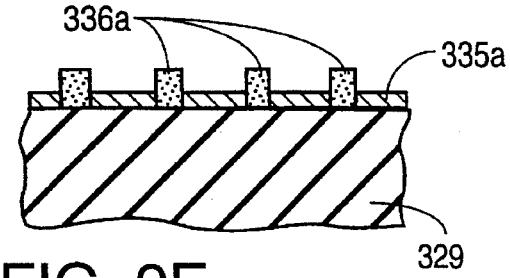

A layer 336 of negative photoresist capable of acting as a sandblast mask is deposited on the upper surface of the structure as depicted in FIG. 9D. Photoresist mask 336 is exposed to actinic radiation from the back (or lower) side of transparent body 329. Metal portions 335*a* serve as a mask to prevent the overlying portions of photoresist 336 from being exposed to the radiation. The unexposed portions of photoresist 336 are removed to create the structure shown in FIG. 9E. Items 336*a* are the remaining portions of photoresist 336.

Figure 9F:
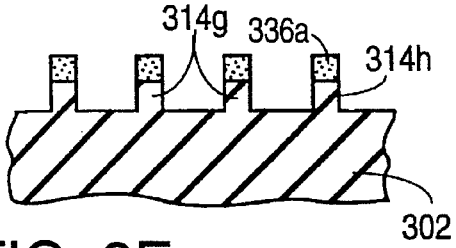
Figure 9G:
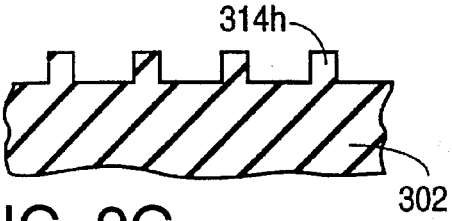

Using photoresist mask 336*a*, a selective removal operation is conducted to remove metal portions 335*a* and underlying portions of body 329 to a specified depth as shown in FIG. 9F. The remainder of body 329, constitutes faceplate 302 and an overlying pattern of ridges 314*h*. The material removal is done by sandblasting. If any of photoresist 336*a* is present at the end of the sandblasting, the remainder of photoresist 336*a* is removed to produce the structure of FIG. 9G.

Figure 9H:
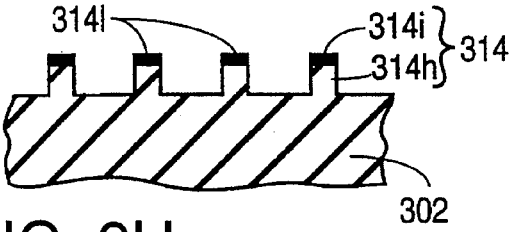
Figure 9I:
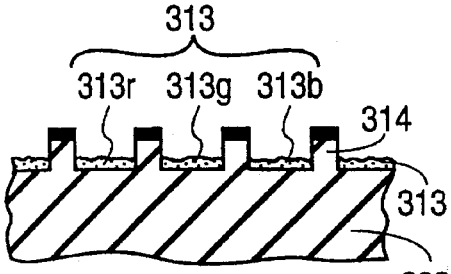
Figure 9J:
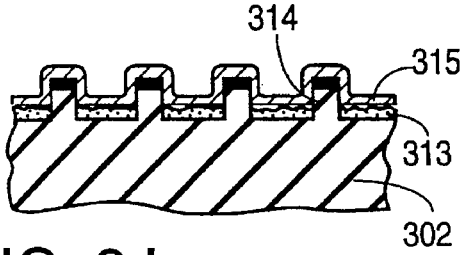

Dark metallic ridge portions 314*i* are formed on ridges 314*h* in the same way that dark ridge portions 314*g* are provided on ridges 314*f* in the process FIG. 8. FIG. 9H shows the resulting structure in which each dark ridge portion 314*i* and underlying ridge 314*h* constitute one of dark ridges 314. The light-emitting structure is completed in the manner described above for the process of FIG. 7. The formation of phosphor stripes 313 is illustrated in FIG. 9I. FIG. 9J illustrates the placement of light-reflective layer 315 over stripes 313 and ridges 314.

After fabricating the cathode structure for the CRT display of FIG. 2 according to one of the processes described in FIGS. 6–9, spacer walls 308 and outer walls 304 are appropriately placed between the cathode structure and the light-emitting black-matrix structure while the components of the display are in a chamber pumped down to a pressure below $10^{-7}$ torr. The display is then sealed at 300°–600° C., typically 450° C.

Dark ridges 314 soften, as described above, at a temperature in the range of 300°–700° C. depending on whether they consist of certain metals, solder glass, or glass. The ridge-softening temperature is typically chosen to be approximately equal to or less than the display-sealing temperature. As a result, spacer walls 308 penetrate slightly into ridges 314 during the sealing process. This compensates for differences in height among walls 308.

If the ridge-softening temperature exceeds the display-sealing temperature, dark ridges 314 can be pre-softened just before the CRT display is sealed. In that case, spacer walls 308 again penetrate slightly into ridges 314 during sealing to compensate for spacer-wall height differences.

While the invention has been described with reference to particular embodiments, this description is solely for the purpose of illustration and is not to be construed as limiting this scope of the invention claimed below. For example, the dark portions of ridges 314 in each of the process sequences of FIGS. 8 and 9 could be moved from the tops of ridges 314 to their bottoms by providing a layer of dark material on top of transparent body 329 at the beginning of the process sequence and then deleting the steps involved in forming upper ridge portions 314*g* or 314*i*.

Figure 10:
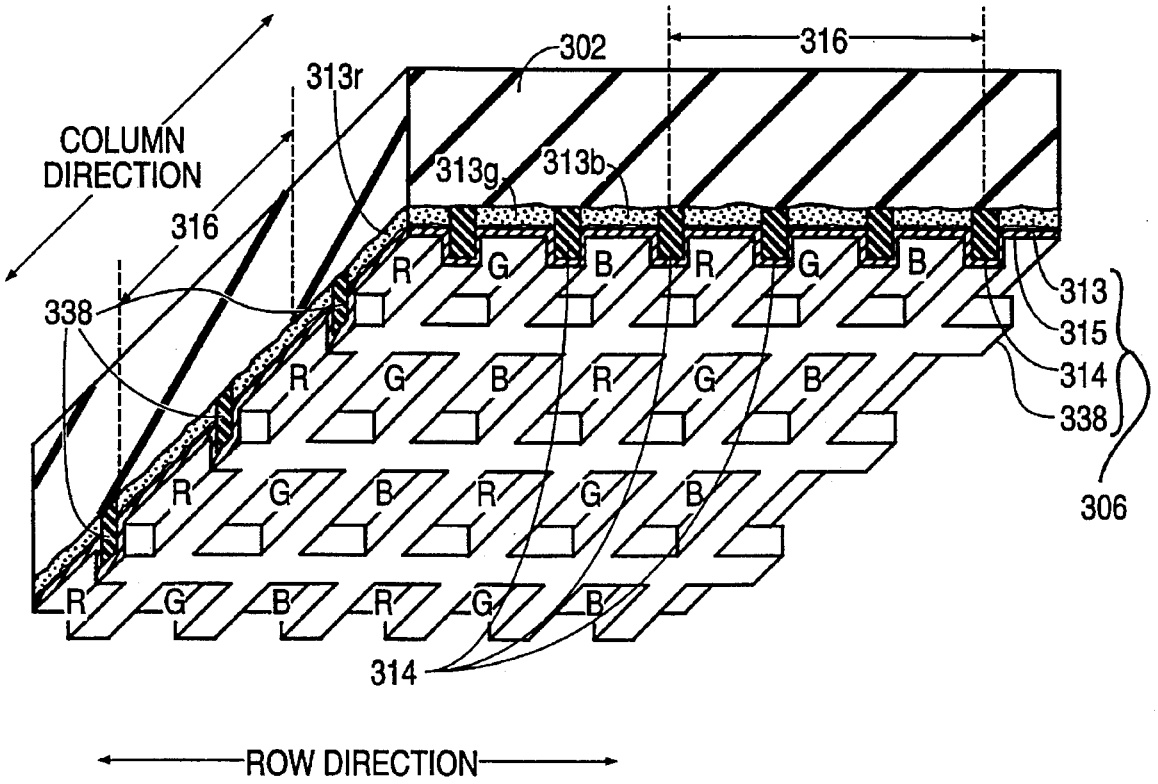
FIG. 10 is a cross-sectional perspective view of a portion of a variation of the flat-panel CRT display of FIG. 2 in accordance with the invention.

Additional parallel dark non-reflective ridges could be formed on faceplate 302 so as to extend perpendicular to, and therefore meet, ridges 314. FIG. 10 illustrates a variation of the faceplate structure of FIG. 2 in which dark non-reflective ridges 338, constituted the same as ridges 314, extend perpendicular to ridges 314 along the interior surface of faceplate 302. Light-emitting structure 306 then consists of light-emissive regions 313, ridges 314 and 338, and light-reflective layer 315.

Phosphor stripes 313 could be created from thin phosphor films instead of phosphor particles. Light-emissive regions 313 could be implemented with elements other than phosphors (in particle or film form). Instead of being flat, the faceplates and backplates in the present CRT display could be curved.

A transparent anode that directly adjoins faceplate 302 could be used in place of, or in conjunction with light-reflective layer 315. Such an anode would typically consist of a layer of a transparent electrically conductive material such as indium-tin oxide. Faceplate 302 and, when present, the adjoining transparent anode then constitute a main section of the light-emitting black-matrix structure.

The invention is not limited to use in displays, but can be used in flat panel devices used for other purposes such as optical signal processing, optical addressing for controlling devices such as phased array radar devices, or scanning of an image to be produced on another medium such as in copier or printers. Various applications and modifications may thus be made by those skilled in the art without departing from the true scope and spirit of the invention as defined in the appended claims.

We claim:

1. An optical device comprising:

first and second plates having respective interior surfaces that face, and are spaced apart from, each other;

a pattern of ridges situated over the interior surface of the first plate, each ridge comprising a dark region that consists primarily of at least one of metal, ceramic, semiconductor, and carbide;

a plurality of light-emissive regions situated over the interior surface of the first plate in spaces between the ridges, the first plate being transparent at least in portions extending under the light-emissive regions, the ridges extending further away from the first plate than the light-emissive regions;

an array of laterally separated sets of electron-emissive elements situated over the interior surface of the second plate, light being produced by the light-emissive regions upon receiving electrons from the electron-emissive elements, the ridges being substantially non-emissive of light relative to the light-emissive regions when the ridges receive electrons from the electron-emissive elements; and supporting structure that supports the plates and keeps them spaced apart from each other.

2. A device as in claim 1 wherein the dark region of each ridge encompasses substantially the entire width of that ridge and at least part of its height.

3. A device as in claim 2 wherein the supporting structure includes a group of laterally separated internal supports situated between the ridges and the second plate so as to cross the ridges, the internal supports being spaced apart from the light-emissive regions and extending towards areas between the electron-emissive elements.

4. A device as in claim 2 wherein at least part of the ridges extend generally in a first direction, and the internal supports extend generally in a second direction perpendicular to the first direction.

5. A device as in claim 3 wherein each internal support comprises a spacer wall.

6. A device as in claim 5 wherein the supporting structure further includes an outer wall extending largely from the first plate laterally beyond the plurality of light-emissive regions to the second plate laterally beyond the array of sets of electron-emissive elements.

7. A device as in claim 2 wherein the ridges have an average width in the range of 10–50 μm.

8. A device as in claim 2 further including a light-reflective layer situated over the light-emissive regions for reflecting light from the light-emissive regions towards the first plate.

9. A device as in claim 2 wherein selected ones of the light-emitting regions produce light of at least two colors.

10. A device as in claim 2 wherein each of the sets of electron-emissive elements comprises at least one field emitter.

* * * * *